US005690244A

United States Patent [19]

Darr

[11] Patent Number: 5,690,244

[45] Date of Patent: Nov. 25, 1997

[54] BLOW MOLDED CONTAINER HAVING PANELED SIDE WALL

[75] Inventor: Richard C. Darr, Seville, Ohio

[73] Assignee: Plastipak Packaging, Inc., Plymouth, Mich.

[21] Appl. No.: 575,346

[22] Filed: Dec. 20, 1995

[51] Int. Cl.[6] ..... B65D 1/02; B65D 1/42

[52] U.S. Cl. ..... 215/382; 215/380; 215/900; 220/673; 220/675

[58] Field of Search ..... 215/381–383, 215/380, 900; 220/673, 675

[56] References Cited

U.S. PATENT DOCUMENTS

| | | | |
|---|---|---|---|
| 3,335,902 | 8/1967 | Jauorik | 220/673 |
| 4,170,622 | 10/1979 | Uhlig | 264/520 |
| 4,497,855 | 2/1985 | Agrawal et al. | 215/383 X |
| 5,027,963 | 7/1991 | Robbins, III | 215/382 X |
| 5,054,632 | 10/1991 | Alberghini et al. | 215/381 |
| 5,067,622 | 11/1991 | Garver et al. | 220/675 X |
| 5,080,244 | 1/1992 | Yoshino | 215/382 X |
| 5,178,290 | 1/1993 | Ota et al. | 215/382 |
| 5,224,614 | 7/1993 | Bono et al. | 220/675 X |
| 5,279,433 | 1/1994 | Krishnakumar et al. | 215/381 |
| 5,303,834 | 4/1994 | Krishnakumar et al. | 220/675 X |
| 5,398,826 | 3/1995 | Takakusaki et al. | 220/675 X |

FOREIGN PATENT DOCUMENTS 0155763 10/1989 European Pat. Off. .

*Primary Examiner*—Sue A. Weaver
*Attorney, Agent, or Firm*—Brooks & Kushman P.C.

[57] ABSTRACT

A plastic blow molded container (10) of polyethylene terephthalate has a side wall (18) at least three vertically spaced horizontal ribs (38) of an annular shape and at least (12) vertical ribs (40) spaced circumferentially and extending between the horizontal ribs to cooperate therewith to define generally rectangular panels (42) that are capable of flexing inwardly to accommodate for shrinkage upon cooling. The construction of the container allows it to have a lightweight construction according to the equation:

$$W_G < 12_G + 34V_G$$

wherein $W_G$ is the weight in grams of the container, $12_G$ is 12 grams, and $34V_G$ is a weight in grams that is 34 times the internal volume of the container in liters. The horizontal ribs (38), the vertical ribs (40), and the rectangular panels (42) are constructed and positioned to facilitate label application to the container side wall (18).

13 Claims, 3 Drawing Sheets

BLOW MOLDED CONTAINER HAVING PANELED SIDE WALL

TECHNICAL FIELD

This invention relates to a container blow molded from polyethylene terephthalate with a paneled side wall.

BACKGROUND ART

Plastic blow molded containers for holding food or beverages are conventionally made from polyethylene terephthalate and often have to be capable of being hot filled in order to provide the requisite sterilization of the container contents. After such hot filling, the container eventually contracts as the contents are cooled. As illustrated by U.S. Pat. No. 5,303,834 Krishnakumar et al, the container side wall has previously had panels that are capable of flexing inwardly to accommodate for the shrinkage of the contents upon cooling, and this container also has a circumferential ring located above the side wall panels. See also U.S. Pat. No. 4,170,622 Uhlig which discloses a blown hollow article having a ribbed interior as well as European Patent 155763 which discloses a squeezable container that can be hot filled.

Blow molded polyethylene terephthalate containers must have sufficient weight so as to have enough material to maintain shape during storage and dispensing of the container contents. The requisite weight for such containers is governed according to the equation:

$$W_G \approx 14_G + 36V_G$$

wherein $W_G$ is the approximate weight in grams of the container, $14_G$ is 14 grams, and $36V_G$ is a weight in grams that is 36 times the internal volume of the container in liters. Blow molding of polyethylene terephthalate containers with a lesser weight than according to this equation is known as "lightweighting" and achieves a more economical container by virtue of using less plastic resin. However, such lightweighting decreases the container wall thickness and strength which can be a particular problem when hot filling of the container is involved.

DISCLOSURE OF INVENTION

An object of the present invention is to provide an improved plastic blow molded container of polyethylene terephthalate that is capable of being hot filled and being made of a lightweight construction that has less plastic resin than conventional blow molded containers so as to thereby reduce cost.

In carrying out the above object, a plastic blow molded container constructed in accordance with the present invention includes a unitary plastic blow molding of polyethylene terephthalate having a central axis and including an upper dispensing end, a lower freestanding base, and a generally round side wall having upper and lower extremities respectively connected to the upper dispensing end and the lower freestanding base. The upper dispensing end of the container includes a dispensing opening and also has a closure cap retainer, while the lower freestanding base has a lower support for supporting the container upright on a horizontal support surface. The side wall of the container has at least three vertically spaced horizontal ribs of an annular shape extending around the extent thereof and also has at least twelve vertical ribs spaced circumferentially and extending between the horizontal ribs thereof to cooperate therewith to define at least twelve generally rectangular panels spaced around the container between each adjacent pair of horizontal ribs, and the rectangular panels being capable of flexing inwardly to accommodate for shrinkage upon cooling after hot filling of the container. The container has a weight according to the equation:

$$W_G < 12_G + 34V_G$$

wherein $W_G$ is the weight in grams of the container, $12_G$ is 12 grams, and $34V_G$ is a weight in grams that is 34 times the internal volume of the container in liters.

In the preferred construction of the plastic blow molded container, the side wall has at least twelve vertical ribs spaced circumferentially and extending upwardly from the uppermost horizontal rib. This preferred construction of the plastic blow molded container also has at least twelve vertical ribs spaced circumferentially and extending downwardly from the lowermost horizontal rib. Thus, the preferred construction has at least twelve vertical ribs spaced circumferentially and extending upwardly from the uppermost horizontal rib and also has at least twelve vertical ribs spaced circumferentially and extending downwardly from the lowermost horizontal rib.

In the preferred construction of the plastic blow molded container, the vertical ribs are aligned in sets to provide vertical rib columns. Furthermore, the horizontal ribs extend radially inward from the generally rectangular panels. In addition, the vertical ribs each has a pair of lateral flanks that extend outwardly from the adjacent generally rectangular panel, and the vertical ribs each has an outwardly located central portion positioned between its pair of lateral flanks. Thus, the preferred construction has the horizontal ribs extending radially inward from the generally rectangular panels as well as having each vertical rib provided with a pair of lateral flanks that extend outwardly from the adjacent generally rectangular panels and also provided with an outwardly located central portion positioned between its pair of lateral flanks.

The container side wall has an external radius $R_1$ about the central axis. Each rectangular panel extends between the adjacent vertical ribs with a radius $R_2$ that is less than ⅔ of the radius $R_1$ but which has a center spaced radially outward from the central axis. This construction provides each rectangular panel with an outwardly bulging shape.

In its most preferred construction, the plastic blow molded container of the invention has a weight according to the equation:

$$W_G \approx 10_G + 32V_G$$

wherein $W_G$ is the weight in grams of the container, $10_G$ is 10 grams, and $32V_G$ is a weight in grams that is 32 times the internal volume of the container in liters.

The objects, features and advantages of the present invention are readily apparent from the following detailed description of the best mode for carrying out the invention when taken in connection with the accompanying drawings.

BEST MODE FOR CARRYING OUT THE INVENTION

Figure 1:
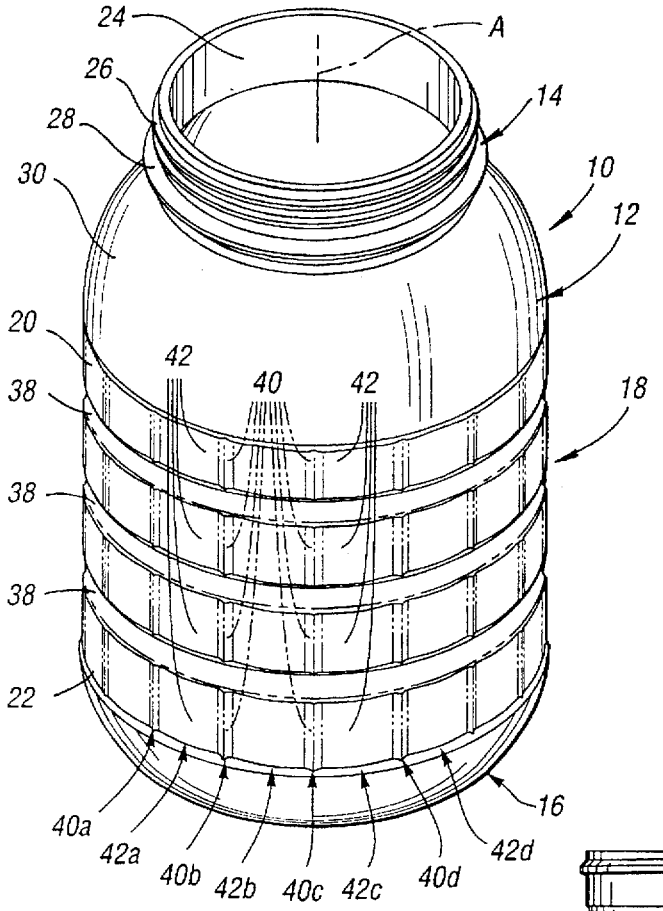
FIG. 1 is a perspective view of a container constructed in accordance with the present invention looking downwardly from one side.
Figure 2:
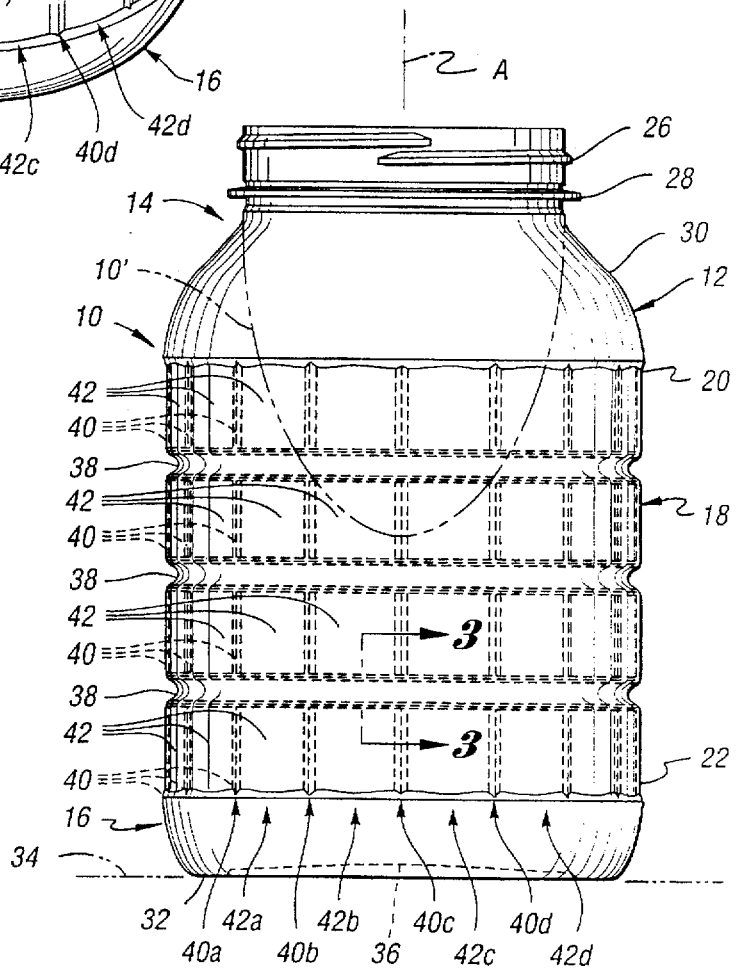
FIG. 2 is an elevational view of the container.

With reference to FIGS. 1 and 2 of the drawings, a plastic blow molded container that is constructed in accordance with the present invention is generally indicated by 10 and is constituted by a unitary plastic blow molding 12 of polyethylene terephthalate. This container blow molding 12 has a central axis A and is blow molded from a preform 10' indicated by phantom line representation in FIG. 2. It will be noted that the preform 10' has a shorter height than the blow molded container 10 since it is axially stretched during the blow molding process to provide biaxial orientation that strengthens the container. The preform 10' is injection molded from polyethylene terephthalate plastic resin in any conventional manner.

With continued reference to FIGS. 1 and 2, the polyethylene terephthalate blow molding 12 that provides the container 10 includes an upper dispensing end 14, a lower freestanding base 16, and a generally round side wall 18 having upper and lower extremities 20 and 22 respectively connected to the upper dispensing end and the lower freestanding base.

As illustrated in FIG. 1, the upper dispensing end 14 of the container includes a dispensing opening 24 through which the container is initially filled and through which its contents are subsequently dispensed. A closure cap retainer 26 of the upper dispensing end is provided by a helical thread to secure an unshown closure cap after filling of the container and is located above a neck flange 28 which in turn is located above a dome 30 that extends downwardly to the round side wall 18.

As best illustrated in FIG. 2, the lower freestanding base 16 of the container has a lower support 32 which is illustrated as an annular surface for supporting the container on a horizontal support surface 34 in an upright manner. This annular support 32 extends around the base 16 about a central region 36 that extends upwardly to prevent the container from rocking even when the central region is deflected downwardly a certain extent after filling.

Figure 5:
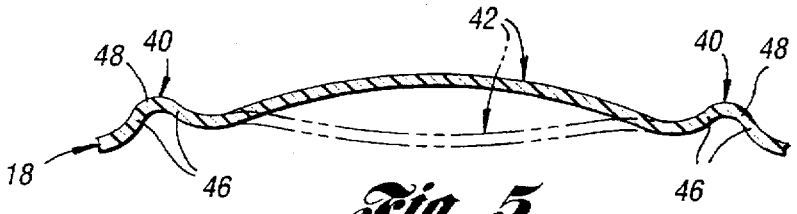
FIG. 5 is a view similar to FIG. 4 illustrating the manner in which panels of the container side wall flex to accommodate for shrinkage after hot filling.

As illustrated in both FIGS. 1 and 2, the side wall 18 of the container has at least three vertically spaced horizontal ribs 38 of an annular shape extending around the extent thereof and also has at least twelve vertical ribs 40 spaced circumferentially and extending between the horizontal ribs thereof to cooperate therewith to define generally rectangular panels 42. After hot filing of the container, these rectangular panels 42 are capable of flexing inwardly as illustrated in FIG. 5 by phantom line representation to accommodate for shrinkage upon cooling.

By virtue of the paneled construction of the side wall 18, the container can have a relatively light weight according to the equation:

$$W_G < 12_G + 34V_G$$

wherein $W_G$ is the weight in grams of the container, $12_G$ is 12 grams, and $34V_G$ is a weight in grams that is 34 times the internal volume of the container in liters. Thus, the weight of the container in grams is 12 grams plus a weight in grams that is 34 times the internal volume of the container in liters.

Figure 6:
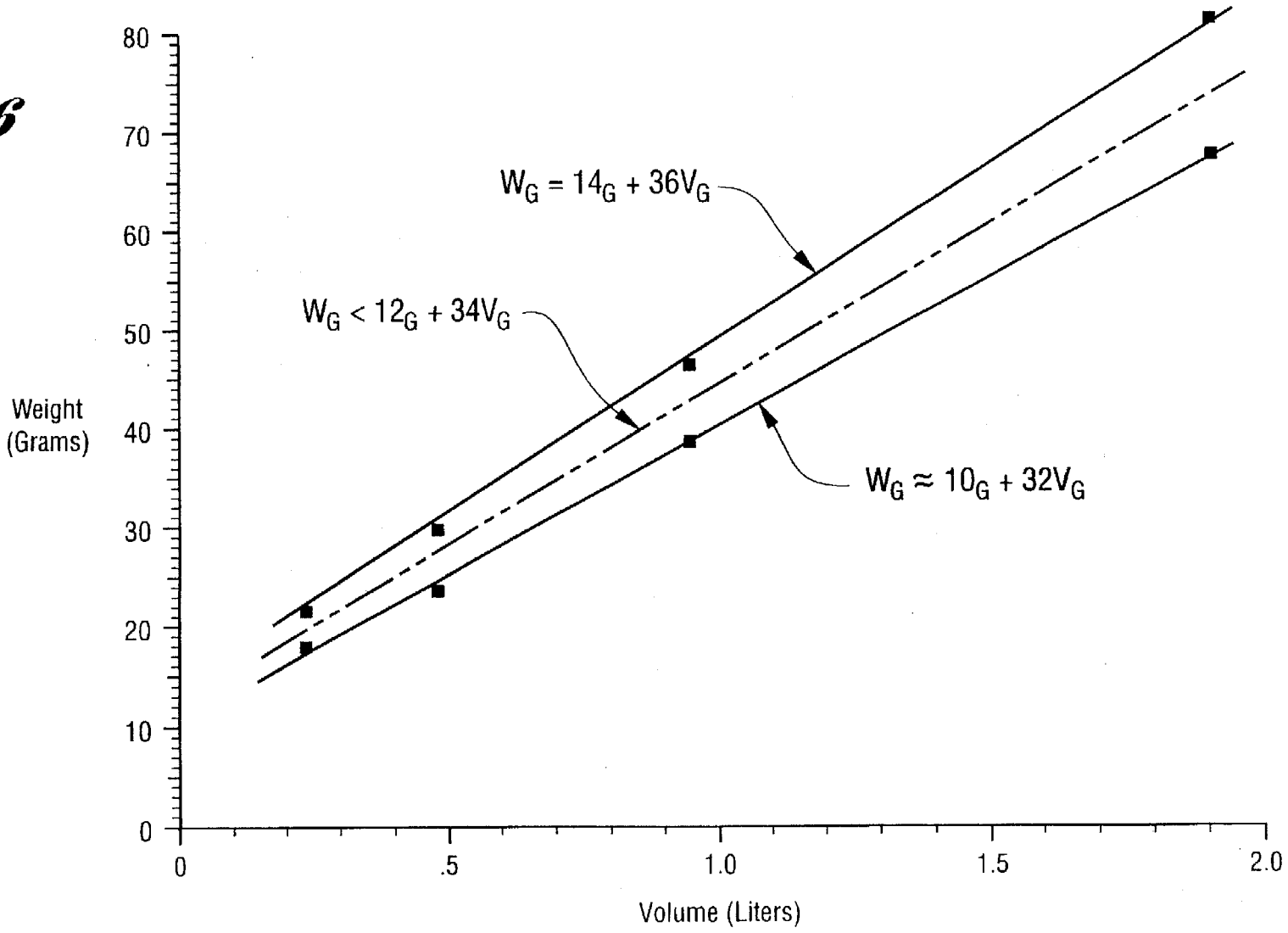
FIG. 6 is a graphical view that illustrates conventional polyethylene terephthalate container weights by the equation of the upper line, the amount of weight in accordance with lightweighting as shown by the equation of the middle phantom line, and the optimal lightweighting achieved in accordance with the present invention by the equation of the lower line.

As illustrated in FIG. 6, conventional plastic blow molded containers of polyethylene terephthalate are illustrated by the upper line and have a weight that is governed by the equation:

$$W_G \approx 14_G + 36V_G$$

wherein $W_G$ is the approximate weight in grams of the container, $14_G$ is 14 grams, and $36V_G$ is a weight in grams that is 36 times the internal volume of the container in liters. Containers in accordance with the present invention have a weight below the phantom indicated middle line of FIG. 6 that is defined by the equation:

$$W_G < 12_G + 34V_G$$

whose parameters are described above. Furthermore, with the specific construction of the container as is hereinafter more fully described, it is possible for the container to have an even lighter weight governed by the equation:

$$W_G = 10_G + 32V_G$$

wherein $W_G$ is the weight in grams of the container, $10_G$ is 10 grams, and $32V_G$ is a weight in grams that is 32 times the internal volume of the container in liters. Thus, polyethylene terephthalate resin weight savings of 15% to 20% are possible while still permitting hot filling of the containers by virtue of the flexing of the rectangular panels inwardly upon shrinkage to the phantom line position of FIG. 5. Despite this inwardly flexing, the overall shape and apparent size of the container does not change substantially due to the large number of rectangular panels involved.

As illustrated in FIGS. 1 and 2, the side wall 18 of the container has at least twelve vertical ribs 40 spaced circumferentially and extending upwardly from the uppermost horizontal rib 38 with their upper ends terminating adjacent the dome 30 in a manner that provides further rectangular panels 42. Furthermore, the side wall 18 also has at least twelve vertical ribs 40 spaced circumferentially and extending downwardly from the lowermost horizontal rib 38 and terminating at the freestanding base 16 in a manner that provides further rectangular panels 42.

It should be noted that the number of vertical ribs 40 and panels 42 around the side wall at each vertical location will normally have to be greater for larger containers so that the rectangular panels are small enough so that their circumferential extent is not so great so as to prevent the inward flexing that accommodates for the shrinkage upon cooling. For example, the specific container illustrated has a side wall diameter of approximately 9.5 centimeters and has sixteen vertical ribs 40 and sixteen rectangular panels 42 at each vertical location. Containers with a smaller diameter may function with less than sixteen ribs 40 and rectangular panels 42 but need to have at least 12 ribs and rectangular panels in order for the inwardly panel flexing to take place upon cooling as previously described. Larger diameter containers may require more than 16 ribs and panels in order to maintain the rectangular panels sufficiently small so the inward flexing can take place upon cooling.

As best illustrated in FIG. 2, the vertical ribs 40 of the container 10 illustrated are aligned in sets to provide vertical rib columns 40*a*, 40*b*, 40*c*, 40*d*, etc. As such, the rectangular panels 42 are also aligned in sets to provide vertical panel columns 42*a*, 42*b*, 42*c*, 42*d*, etc.

Figure 3:
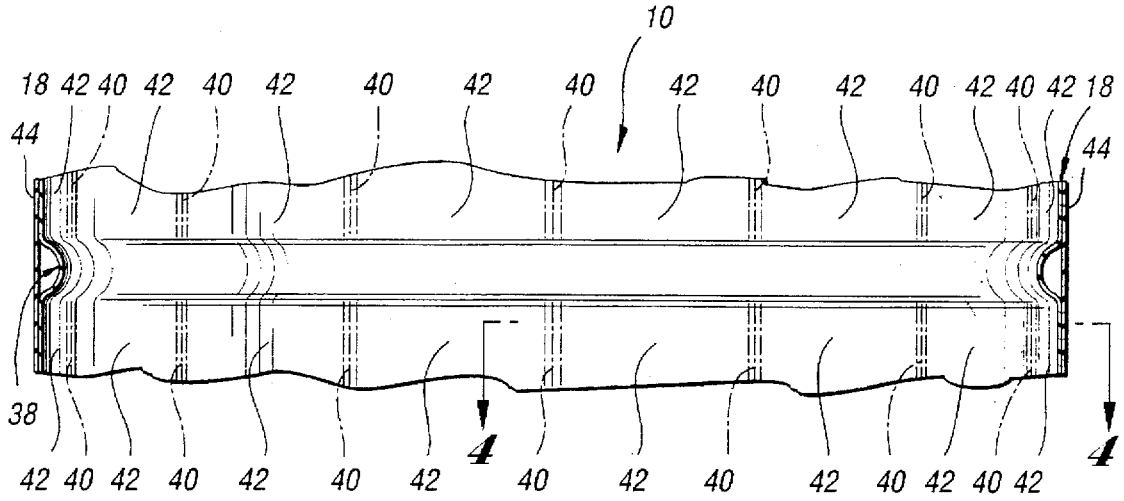
FIG. 3 is an enlarged sectional view of the container taken along the direction of line 3—3 in FIG. 2 to illustrate the rib construction of the container.

As best illustrated in FIG. 3, each horizontal rib 38 extends radially inward from the generally rectangular panels 42 with a curved cross section that is symmetrical between its upper and lower ends. Each vertical rib 40 and rectangular panel 42 terminates at the adjacent rib 38. This inward extension of the horizontal ribs 38 facilitates application of a container label 44 over the side wall 18.

Figure 4:
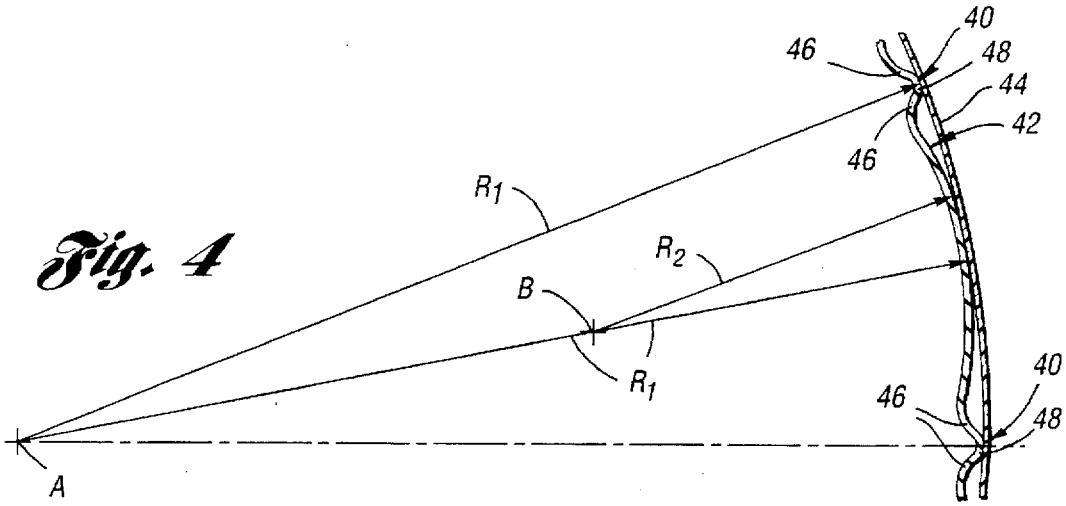
FIG. 4 is a plan view taken partially in section through the container along the direction of line 4—4 in FIG. 3.

As illustrated in FIGS. 4 and 5, each of the vertical ribs 40 has a pair of lateral flanks 46 that extend outwardly from the adjacent rectangular panels 42. Each vertical rib 40 also has an outwardly located central portion 48 positioned between its pair of lateral flanks 46. Furthermore, the external radius $R_1$ of the container from the central axis A to the center of the rectangular panels 42 is approximately equal to the radius $R_1$ of the container at the central portion 48 of each vertical rib 40 so as to further facilitate the attachment of the label 44 to the container. Thus, by having the horizontal ribs 38 extending inwardly as illustrated in FIG. 3 and having the outermost extent of the vertical ribs 40 and rectangular panels 42 provided with the same radius, the label 44 can be applied smoothly without excessive undesired wrinkling.

As shown in FIG. 4, the rectangular panels 42 extend between the ribs 40 about a radius $R_2$ that is less than ⅔ the external radius $R_1$ of the container and, most preferably, approximately 55% of the external radius $R_1$. However, the rectangular panel radius $R_2$ has a center B that is located radially outward from the central axis A. This construction provides a slightly bulging panel construction that facilitates the inward flexing for accommodating shrinkage.

While the best mode for carrying out the invention has been described in detail, those familiar with the art to which this invention relates will recognize various alternative designs and embodiments for practicing the invention as defined by the following claims.

What is claimed is:

1. A plastic blow molded container comprising:

a unitary plastic blow molding of polyethylene terephthalate having a central axis and including an upper dispensing end, a lower freestanding base, and a generally round side wall having upper and lower extremities respectively connected to the upper dispensing end and the lower freestanding base;

the upper dispensing end including a dispensing opening and also having a closure cap retainer;

the lower freestanding base having a lower support for supporting the container upright on a horizontal support surface;

the side wall having at least three vertically spaced horizontal ribs of an annular shape extending around the extent thereof and also having at least twelve vertical ribs spaced circumferentially and extending between the horizontal ribs thereof to cooperate therewith to define at least twelve generally rectangular panels spaced around the container between each adjacent pair of horizontal ribs, and the rectangular panels being capable of flexing inwardly to accommodate for shrinkage upon cooling after hot filling of the container; and the container having a weight according to the equation:

$$W_G < 12_G + 34V_G$$

wherein $W_G$ is the weight in grams of the container, $12_G$ is 12 grams, and $34V_G$ is a weight in grams that is 34 times the internal volume of the container in liters.

2. A plastic blow molded container as in claim 1 wherein the side wall has at least twelve vertical ribs spaced circumferentially and extending upwardly from the uppermost horizontal rib.

3. A plastic blow molded container as in claim 1 wherein the side wall has at least twelve vertical ribs spaced circumferentially and extending downwardly from the lowermost horizontal rib.

4. A plastic blow molded container as in claim 1 wherein the side wall has at least twelve vertical ribs spaced circumferentially and extending upwardly from the uppermost horizontal rib, and the side wall also having at least twelve vertical ribs spaced circumferentially and extending downwardly from the lowermost horizontal rib.

5. A plastic blow molded container as in any one of claims 1 through 4 wherein the vertical ribs are aligned in sets to provide vertical rib columns.

6. A plastic blow molded container as in claim 1 wherein the horizontal ribs extend radially inward from the generally rectangular panels.

7. A plastic blow molded container as in claim 1 wherein the vertical ribs each has a pair of lateral flanks that extend outward from the adjacent generally rectangular panels, and the vertical ribs each having an outwardly located central portion positioned between its pair of lateral flanks.

8. A plastic blow molded container as in claim 1 wherein the container side wall has an external radius $R_1$ about the central axis, and each rectangular panel extending between the adjacent vertical ribs with a radius $R_2$ that is less than ⅔ of the radius $R_1$ but which has a center spaced radially outward from the central axis.

9. A plastic blow molded container as in claim 1 wherein the horizontal ribs extend radially inward from the generally rectangular panels, each vertical rib having a pair of lateral flanks that extend outwardly from the adjacent generally rectangular panels, and the vertical ribs each having an outwardly located central portion positioned between its pair of lateral flanks.

10. A plastic blow molded container as in claim 1 that has a weight according to the equation:

$$W_G = 10_G + 32V_G$$

wherein $W_G$ is the weight in grams of the container, $10_G$ is 10 grams, and $32V_G$ is a weight in grams that is 32 times the internal volume of the container in liters.

11. A plastic blow molded container comprising:

a unitary plastic blow molding of polyethylene terephthalate having a central axis and including an upper dispensing end, a lower freestanding base, and a generally round side wall of an external radius $R_1$ and having upper and lower extremities respectively connected to the upper dispensing end and the lower freestanding base;

the upper dispensing end including a dispensing opening and also having a closure cap retainer;

the lower freestanding base having a lower support for supporting the container upright on a horizontal support surface;

the side wall having at least three vertically spaced horizontal ribs of an annular shape extending around the extent thereof and inwardly therefrom, the side wall also having at least twelve vertical ribs spaced circumferentially and extending between the horizontal ribs thereof as well as upwardly from the uppermost rib and downwardly from the lowermost horizontal rib with the vertical ribs aligned in vertical sets providing vertical rib columns and with the horizontal and vertical ribs cooperating to define at least twelve generally rectangular panels spaced around the container between each adjacent pair of horizontal ribs, and the rectangular panels being capable of flexing inwardly to accommodate for shrinkage upon cooling after hot filling of the container, each vertical rib having a pair of flanks that extend outwardly from the adjacent rectangular panels and an outwardly located central portion positioned between its pair of flanks, and each rectangular panel extending between the adjacent pair of vertical ribs with a radius $R_2$ that is less than ⅔ of the external side wall radius $R_1$ and that has a center spaced outwardly from the central axis of the container; and the container having a weight according to the equation:

$$W_G[<]\cong 10_G+32V_G$$

wherein $W_G$ is the weight in grams of the container, $10_G$ is 10 grams, and $32V_G$ is a weight in grams that is 32 times the internal volume of the container in liters.

12. A plastic blow molded container comprising:

a unitary plastic blow molding of polyethylene terephthalate having a central axis and including an upper dispensing end, a lower freestanding base, and a generally round side wall having upper and lower extremities respectively connected to the upper dispensing end and the lower freestanding base;

the upper dispensing end including a dispensing opening and also having a closure cap retainer;

the lower freestanding base having a lower support for supporting the container upright on a horizontal support surface;

the side wall having at least three vertically spaced horizontal ribs of an annular shape extending around the extent thereof and also having at least twelve vertical ribs spaced circumferentially and extending between the horizontal ribs thereof to cooperate therewith to define at least twelve generally rectangular panels spaced around the container between each adjacent pair of horizontal ribs, and each rectangular panel having an outwardly bulging shape and being capable of flexing inwardly to accommodate for shrinkage upon cooling after hot filling of the container; and the container having a weight according to the equation:

$$W_G<12_G+34V_G$$

wherein $W_G$ is the weight in grams of the container, $12_G$ is 12 grams, and $34V_G$ is a weight in grams that is 34 times the internal volume of the container in liters.

13. A plastic blow molded container comprising:

a unitary plastic blow molding of polyethylene terephthalate having a central axis and including an upper dispensing end, a lower freestanding base, and a generally round side wall of an external radius $R_1$ and having upper and lower extremities respectively connected to the upper dispensing end and the lower freestanding base;

the upper dispensing end including a dispensing opening and also having a closure cap retainer;

the lower freestanding base having a lower support for supporting the container upright on a horizontal support surface;

the side wall having at least three vertically spaced horizontal ribs of an annular shape extending around the extent thereof and also having at least twelve vertical ribs spaced circumferentially and extending between the horizontal ribs thereof to cooperate therewith to define at least twelve generally rectangular panels spaced around the container between each adjacent pair of horizontal ribs, the side wall having at least twelve vertical ribs spaced circumferentially and extending upwardly from the uppermost horizontal rib, the side wall also having at least twelve vertical ribs spaced circumferentially and extending downwardly from the lowermost horizontal rib, and each rectangular panel extending between the adjacent pair of vertical ribs with a radius $R_2$ that is less than ⅔ of the side wall external radius $R_1$ and that has a center spaced outwardly from the central axis of the container such that the rectangular panel has an outwardly bulging shape that is capable of flexing inwardly to accommodate for shrinkage upon cooling after hot filling of the container; and the container having a weight according to the equation:

$$W_G<12_G+34V_G$$

wherein $W_G$ is the weight in grams of the container, $12_G$ is 12 grams, and $34V_G$ is a weight in grams that is 34 times the internal volume of the container in liters.

* * * * *